US006524181B2

(12) United States Patent
Wasson

(10) Patent No.: US 6,524,181 B2
(45) Date of Patent: Feb. 25, 2003

(54) GARAGE VENTING DEVICE

(76) Inventor: Walter L. Wasson, 19652 Villa Dr. North, Lathrup Village, MI (US) 48076

( * ) Notice: Subject to any disclaimer, the term of this patent is extended or adjusted under 35 U.S.C. 154(b) by 0 days.

(21) Appl. No.: 09/981,641

(22) Filed: Oct. 15, 2001

(65) Prior Publication Data

US 2002/0081963 A1 Jun. 27, 2002

Related U.S. Application Data

(60) Provisional application No. 60/240,034, filed on Oct. 16, 2000.

(51) Int. Cl.[7] ..... F24F 11/02

(52) U.S. Cl. ..... 454/195; 454/343; 454/353; 236/49.3

(58) Field of Search ..... 454/195, 256, 454/258, 259, 338, 341, 343, 350, 351, 353; 236/49.3

(56) References Cited

U.S. PATENT DOCUMENTS

| | | | | | |
|---|---|---|---|---|---|
| 1,959,918 | A | * | 5/1934 | Hochbaum | 454/341 |
| 2,084,807 | A | * | 6/1937 | Hueglin | 454/195 |
| 5,626,288 | A | * | 5/1997 | Huber | 165/248 |
| 5,947,814 | A | * | 9/1999 | Czeck et al. | 454/195 |
| 5,976,009 | A | * | 11/1999 | Achen | 454/195 |
| 6,036,595 | A | * | 3/2000 | Vole | 454/239 |
| 6,386,969 | B1 | * | 5/2002 | O'Brien | 454/195 |

* cited by examiner

*Primary Examiner*—Harold Joyce
(74) *Attorney, Agent, or Firm*—Weiner & Burt, P.C.; Irving M. Weiner; Pamela S. Burt

(57) ABSTRACT

Apparatus for removing excessive heat which has built up in a garage, including vents, movable louvers connected to each vent, exhaust fans, and a fan motor. The fan motor may be controlled by a manually-operated switch or a thermostat.

2 Claims, 2 Drawing Sheets

FIG. 4
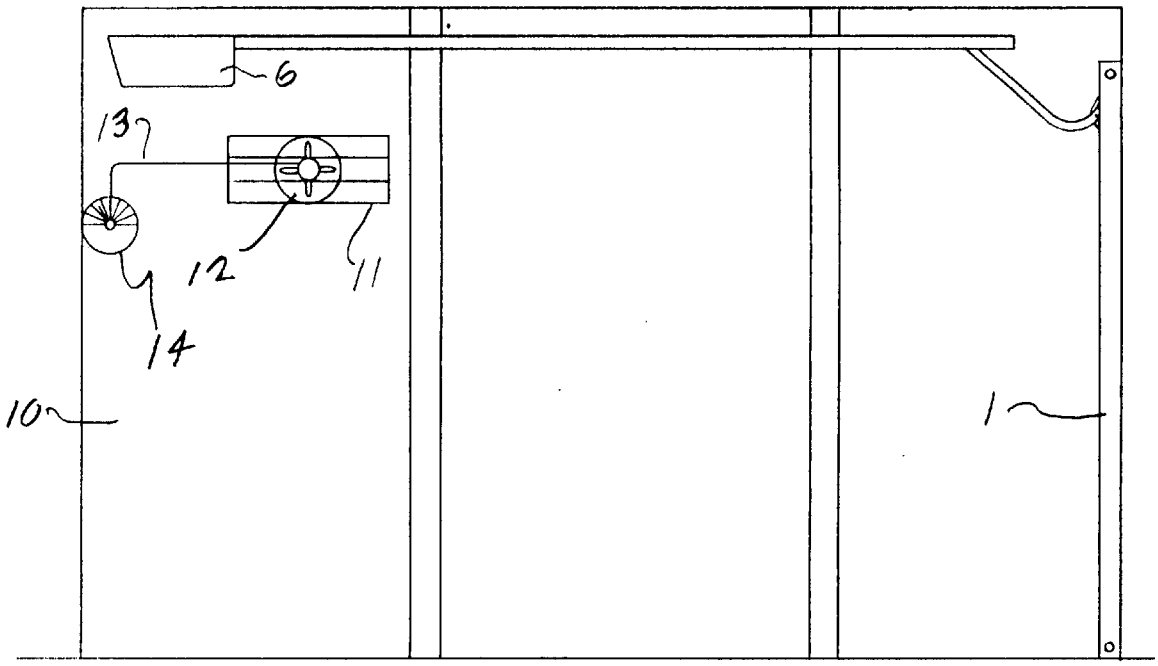
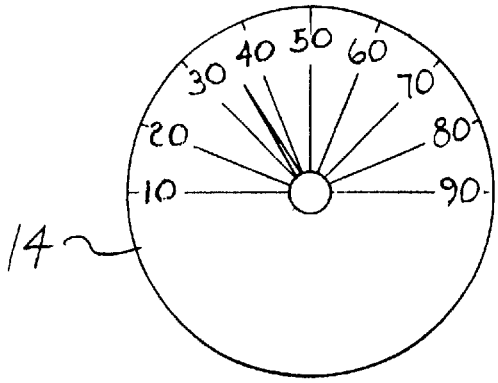
FIG. 5

GARAGE VENTING DEVICE

The present patent application claims priority from U.S. Patent Application No. 60/240,034 filed Oct. 16, 2000.

The present invention relates generally to certain new and useful improvements in devices for removing heat from a garage. More particularly, the present invention relates to novel devices for removing excessive heat which has built up in a garage where temperatures can exceed 100° F.

BACKGROUND OF THE INVENTION

Conventional garages are rarely provided with devices for removing heat from the garage. Consequently, in summer months the temperature in a garage may exceed 100° F.

The heat rises from the garage ofttimes into the house, and consequently raises the temperature in the house causing any air conditioning to be activated and thus increasing cost to the homeowner.

Venting the garage would permit air to circulate and exit so that temperature inside the garage and the adjacent house can be lowered. In addition, this minimizes the chance of flammable liquids exploding.

Various attempts have been tried to remedy and/or avoid the aforementioned problems, but such attempts have been unsuccessful.

The relevant art is exemplified by the following United States patents.

U.S. Pat. No. 2,084,807, issued in 1937 to Hueglin, entitled "VENTILATOR", discloses an apparatus including a supporting panel having an opening therethrough, and a fan mounted in the opening and having a fixed support on the panel. A plurality of louvers are hinged at edges to the panel and are connected together for swinging in unison. Means are provided for simultaneously swinging the louvers outwardly of the panel and energizing the fan.

U.S. Pat. No. 2,643,053, issued in 1953 to Sherman et al., entitled "COMBINATION FAN AND AWNING CONSTRUCTION", discloses a combined fan and sheet metal awning to be positioned outside of a building adjacent a window, door, or the like, for drawing out air from the building. The awning includes side walls. A guard for the fan is held in place by a series of straps depending from a support and having hooks thereon for receiving a protective grill-work of the guard.

U.S. Pat. No 3,061,056, issued in 1962 to Kodaras, entitled "LOUVERED DOOR", discloses a louvered door for ventilated premises. The louvered door includes an air transfer duct having a cross sectional area which is acoustically lined. The combined area of each set of louvers, i.e., the louvers at the inside surface of the door and those at its outside surface, are equal so that there is no reduction or expansion of the cross sectional area of flow of the air as it passes through one set of louvers to leave the room by way of the other set of louvers.

U.S. Pat. No. 4,770,087, issued in 1988 to Danley et al., entitled "GARAGE DOOR VENTILATOR", discloses ventilating or closing inserts for openings in an existing garage door or as original equipment by the manufacturer wherein the inserts selectively ventilate while excluding sun rays and rain or close the opening.

U.S. Pat. No. 5,626,288, issued in 1997 to Huber, entitled "PROCESS AND APPARATUS FOR VENTILATING AN ENCLOSED SPACE", discloses a system for ventilating an enclosed space using a controller which is switchable between a cooling mode that activates a ventilating fan when the temperature in the space reaches a predetermined upper limit and the difference between the inside and outside temperatures reaches a predetermined value, and a heating mode that activates the ventilating fan when the temperature in the space reaches a predetermined lower limit and the difference between the inside and outside temperatures reaches a predetermined value.

U.S. Pat. No. 5,947,814, issued in 1999 to Czeck et al., entitled "GARAGE CO VENTING SYSTEM", discloses a venting system with an electrically operated exhaust fan used in an enclosed garage. In a garage with a door opener with an automatically operative light fixture, electric power to operate the fan is supplied from the light fixture, via an interconnected relay, during the normal preset time the door opener light is operating.

Indeed, it is a desideratum of the present invention to avoid the animadversions of the above-described prior art techniques, devices, mechanisms and systems.

SUMMARY OF THE INVENTION

The present invention provides a novel and unique garage venting apparatus, comprising: one or more venting structures positioned in and operably connected with one or more predetermined portions of a garage to provide a vent therethrough; each said venting structure being operably connected with an associated series of movable venting louvers; each said venting structure being provided with an exhaust fan; and means for selectively energizing and de-energizing each said exhaust fan for removing excessive heat which has built up in said garage.

The present invention provides new and useful devices for removing heat from a garage.

It is, therefore, one of the primary objects of the present invention to provide novel devices for the door or doors and/or walls of a garage for venting excessive heat that has built up therein.

Another object of the invention is to provide a first preferred embodiment wherein vents are provided in the garage door with or without exhaust fans in proximity thereto.

A further object of the invention is to provide vents in one or more walls of the garage with a vent having an exhaust fan in proximity thereto.

An additional object of the invention is to have a thermostat for controlling the movement of louvers in a vent provided in a garage door or wall.

A further object of the invention is to provide a thermostat for controlling an exhaust fan placed in proximity to an exhaust vent in a garage door or wall.

An additional object of the invention is to provide devices as described hereinabove which include a manually-operated handle for moving the louvers on such vents.

The present invention possesses many other advantages and features which will become more apparent to those persons skilled in this area of technology and to others after having read the detailed description of the preferred embodiments of the present invention as set forth hereinbelow in conjunction with the accompanying drawings.

BRIEF DESCRIPTION OF THE DRAWINGS

FIG. 4 illustrates an elevational cross-sectional view of a second preferred embodiment of the present invention.

FIG. 5 shows an enlarged view of the thermostat control which is also depicted in FIG. 4.

DETAILED DESCRIPTION OF SOME PREFERRED EMBODIMENTS

Figure 1:
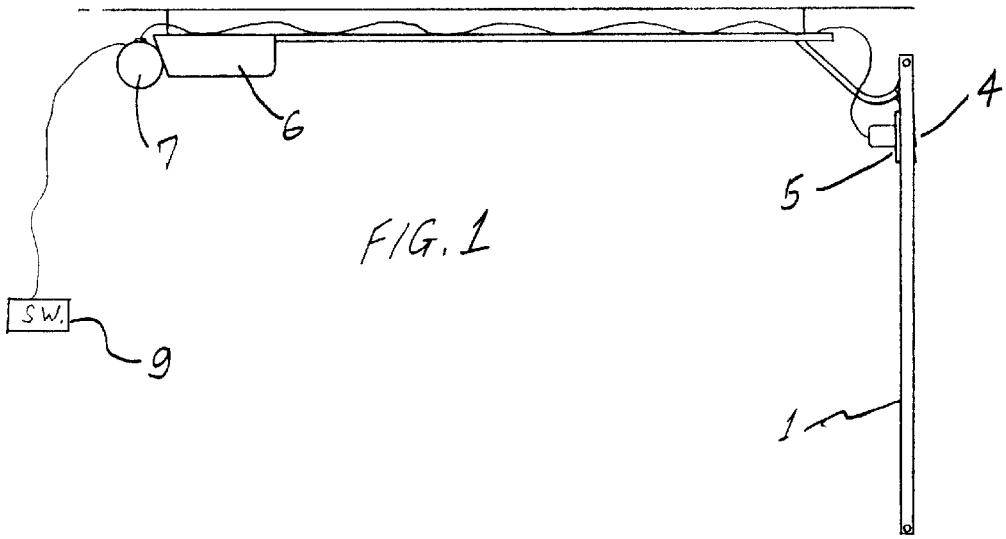
FIG. 1 is a side elevational view of a first preferred embodiment of the present invention.
Figure 2:
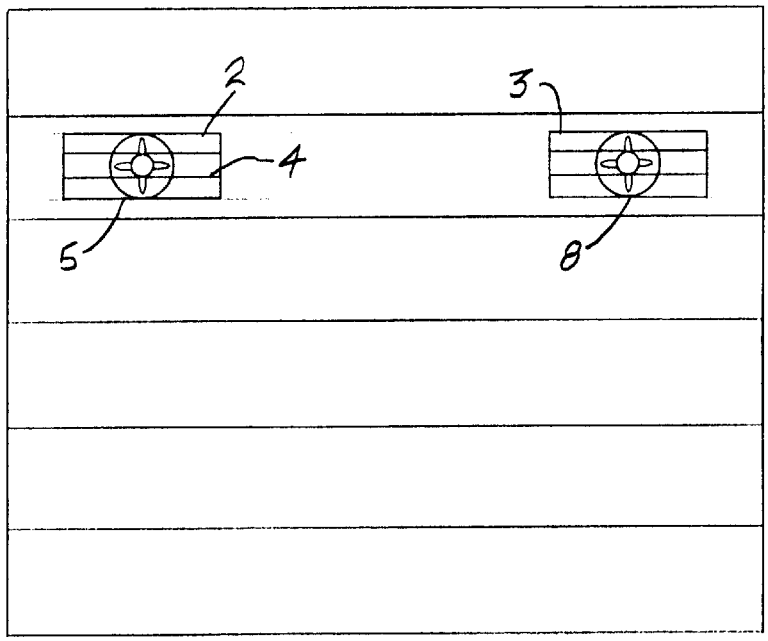
FIG. 2 is an elevational view of the front of the garage door which is depicted in FIG. 1.

FIGS. 1 and 2 illustrate a first preferred embodiment of the present invention.

With reference to FIGS. 1 and 2, there is shown a garage door 1 having two vents 2 and 3 therein. Each vent 2 or 3 is provided with movable louvers 4. Each vent 2 or 3 is provided with an exhaust fan 5 or 8, respectively, which extends into the interior of the garage.

With reference to FIG. 1, the garage door 1 is shown connected to a garage door opener 6. A fan motor 7 is provided preferably, but not necessarily, in the vicinity of the garage door opener 6. The fan motor 7 is connected to the exhaust fans 5 and 8. A switch 9, mounted on a wall or a door leading to the house, controls operation of the fan motor 7.

The user of the device can selectively switch the fan motor 7 ON and OFF when desired, especially when heat has built up in the garage.

Figure 3:
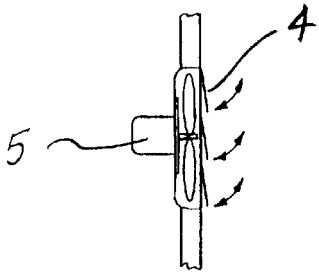
FIG. 3. is a cross-sectional elevational view of the exhaust fan/vent arrangement also shown in FIGS. 1, 2, 4 and 5.

FIG. 3 shows an exhaust fan 5 according to the present invention mounted in the garage door, or alternatively in the wall of the garage as depicted in the embodiment shown in FIG. 4. The movable louvers 4 of the vent can be made to automatically open and close in response to the operation of the fan 5, 8 or 12. The switch 9 and electrical wiring can be made so that there are three speeds for the fan 5, 8 or 12, and the directional flow can be inwardly or outwardly as desired. Alternatively, the fan 5, 8 or 12 can be a three-speed fan which only exhausts. As a further alternative, the fan 5, 8 or 12 can be a single-speed fan which only exhausts.

FIGS. 4 and 5 illustrate a second preferred embodiment of the invention.

In FIG. 4 the vent 11 and exhaust fan 12 are mounted in the side wall 10 of a garage. The motor for the fan 12 can be integral with the fan 12 itself or be separate, as desired.

An electrical connection by wires 13 may be made to a thermostat 14 which will control the automatic energization and de-energization of the fan motor. Alternatively, the thermostat 14 can also be used for controlling the movement of the louvers 4 in a vent 2 or 3 provided in a garage door 1 or wall 10, with or without an exhaust fan 5, 8 or 12 in proximity thereto.

The embodiments of the present invention can be added to existing garages, or can be made as original equipment in the garage as built.

The devices according to the present invention remove heat from the garage, especially during summer months, when the temperature inside the garage may exceed 100° F. Heat may rise from the garage or move from the garage into the adjacent house, thus raising temperatures in the house. This causes the air conditioning to consume more energy, and consequently results in increased cost to the homeowner. Venting the garage permits air to circulate and exit so that temperature inside the garage and the house can be lowered. This results in saving money for the homeowner, and in addition protects the occupants of the house from fire. Ofttimes, articles in the garage are items which are susceptible to exploding at excessive temperatures, such as, for example, car products, cleaning products, lawn and gardening products, gasoline, etc.

There have been illustrated in the accompanying drawings and described herein above several unique and novel preferred embodiments of the present invention which may be constructed in many different configurations, arrangements of components, sizes, and shapes. For example, the shape of the vents 2, 3 or 11 may be rectangular, square, triangular, circular, oval, etc.

Furthermore, it should be understood that many changes, modifications, variations, and other uses and applications of the present invention will become apparent to those persons skilled in this particular area of technology and to others after having been exposed to the present patent application and accompanying drawings.

Any and all such changes, modifications, variations, and other uses and applications which do not depart from the spirit and scope of the present invention are therefore covered by and embraced within the present invention and the patent claims set forth hereinbelow.

What is claimed is:

1. A garage venting apparatus, comprising:

one or more venting structures positioned in a moveable overhead garage door of a garage to provide a vent therethrough;

each said venting structure being operably connected with an associated series of movable venting louvers;

each said series of movable venting louvers being disposed on an exterior surface of said garage door;

each said series of movable venting louvers being positioned to lie flat against said exterior surface of said moveable overhead garage door when its associated venting structure is closed;

each said venting structure being provided with an exhaust fan;

each said exhaust fan being provided with one or more fan blades;

each of said fan blades is confined within the cross-sectional thickness of said moveable overhead garage door;

said moveable louvers of said venting structures being positioned and operably connected to automatically open and close in response to the operation of its associated exhaust fan;

each said exhaust fan extending into the interior of said garage;

said venting structures and said exhaust fans being moveable in unison with said moveable overhead garage door;

control means for energizing and de-energizing said exhaust fans for removing excessive heat which has built up in said garage; and said control means comprises a manually-operable switch for controlling the energizing and de-energizing of said exhaust fans for removing excessive heat which has built up in said garage.

2. A garage venting apparatus, comprising:

one or more venting structures positioned in a moveable overhead garage door of a garage to provide a vent therethrough;

each said venting structure being operably connected with an associated series of movable venting louvers;

each said series of movable venting louvers being disposed on an exterior surface of said garage door;

each said series of movable venting louvers being positioned to lie flat against said exterior surface of said moveable overhead garage door when its associated venting structure is closed;

each said venting structure being provided with an exhaust fan;

each said exhaust fan being provided with one or more fan blades;

each of said fan blades is confined within the cross-sectional thickness of said moveable overhead garage door;

said moveable louvers of said venting structures being positioned and operably connected to automatically open and close in response to the operation of its associated exhaust fan;

each said exhaust fan extending into the interior of said garage;

said venting structures and said exhaust fans being moveable in unison with said moveable overhead garage door;

control means for energizing and de-energizing said exhaust fans for removing excessive heat which has built up in said garage; and said control means includes a thermostat for controlling the automatic energization and de-energization of each said exhaust fan.

* * * * *